US005617916A

United States Patent [19]

Shigenaka et al.

[11] Patent Number: 5,617,916

[45] Date of Patent: Apr. 8, 1997

[54] FIN TUBE HEAT EXCHANGER

[75] Inventors: Toshinori Shigenaka; Tetsuo Mimura; Yukitaka Machida; Ikuo Kohtaka; Takahiro Marumoto, all of Kure, Japan

[73] Assignee: Babcock-Hitachi Kabushiki Kaisha, Japan

[21] Appl. No.: 382,024

[22] PCT Filed: Jul. 20, 1994

[86] PCT No.: PCT/JP94/01198

§ 371 Date: Jan. 31, 1995

§ 102(e) Date: Jan. 31, 1995

[87] PCT Pub. No.: WO95/03520

PCT Pub. Date: Feb. 2, 1995

[30] Foreign Application Priority Data

Jul. 21, 1993 [JP] Japan ..... 5-180495

[51] Int. Cl.$^6$ ..... F28F 1/14

[52] U.S. Cl. ..... 165/184

[58] Field of Search ..... 165/184

[56] References Cited

U.S. PATENT DOCUMENTS

| | | | |
|---|---|---|---|
| 1,932,610 | 10/1932 | Tilley | 257/263 |
| 3,752,228 | 8/1973 | Bosse | 165/184 |
| 4,138,997 | 2/1979 | LaPorte et al. | 165/184 X |
| 4,258,782 | 3/1981 | Kao | 165/184 X |
| 5,195,578 | 3/1993 | Le Goff et al. | 165/184 X |
| 5,240,070 | 8/1993 | Ryan | 165/184 |

FOREIGN PATENT DOCUMENTS

| | | | |
|---|---|---|---|
| 1107259 | 5/1961 | Germany | 165/184 |
| 51-133062 | 10/1976 | Japan . | |
| 0051052 | 4/1979 | Japan | 165/184 |
| 54-174046 | 12/1979 | Japan . | |
| 0130598 | 10/1981 | Japan | 165/184 |
| 58-66794 | 4/1983 | Japan . | |
| 0001995 | 1/1986 | Japan | 165/184 |
| 61-38398 | 2/1986 | Japan . | |
| 61-107098 | 5/1986 | Japan . | |
| 4126997 | 4/1992 | Japan . | |
| 517775 | 7/1976 | U.S.S.R. | 165/184 |
| 340765 | 12/1929 | United Kingdom | 165/184 |

*Primary Examiner*—John Rivell
*Assistant Examiner*—Christopher Atkinson
*Attorney, Agent, or Firm*—Lorusso & Loud

[57] ABSTRACT

A finned tube comprises a tube; and a fin strip having fins formed by forming slits of a predetermined length in a fin portion of a strip and at predetermined intervals, and a base portion in which no slit is formed, and wound around the tube so that the fins thereof extend substantially radially of the tube. The fins are twisted at a twist angle in the range of 2° to 40° to a contact line along which the base portion of the fin strip is in contact with the tube, and inclined at an inclination angle in the range of 2° to 20° to a straight line perpendicular to the axis of the tube. A heat exchanger is provided with a plurality of such finned tubes, and a heat recovery apparatus comprises such a heat exchanger disposed in a combustion gas passage.

28 Claims, 9 Drawing Sheets

○ TWIST ANGLE (α=30 )+ INCLINATION ANGLE OF A FIN (θ=10°)

△ TWIST ANGLE (α=30°) INCLINATION ANGLE OF A FIN BASE PORATION (θ=0-10°)

● TWIST ANGLE AND INCLINATION ANGLE ARE ZERO

FIN TUBE HEAT EXCHANGER

TECHNICAL FIELD

The present invention relates to a finned tube formed by winding a serrated fin around a tube, a finned tube heat exchanger employing such finned tubes, and a heat recovery system having such a fin-tube heat exchanger disposed in an exhaust gas passage.

BACKGROUND ART

Conventional fin strips wound around tubes of, for example, heat exchangers for recovering heat from exhaust gas produced by combustion are those having an L-shaped cross section and fins formed by slitfing the edge thereof and those having a U-shaped cross section and fins formed by slitfing the edge thereof. Disclosed in U.S. Pat. No. 3,652,820 (Patent family: Japanese Utility Model Publication No. 55-42140) is a heat exchanger employing finned tubes each formed by winding a fin strip 4 having fins 3 separated by slits around a tube 1 and twisfing the fins 3 as shown in FIG. 12.

The inventors of the present invention proposed in Japanese Patent Laid-open Publication No. 4-126997 a heat exchanger employing finned tubes each having fins inclined at an inclination angle θ (FIG. 3) in the range of 2° to 20° to a straight line perpendicular to the axis of the tube, and having a fin slit ratio H/h, where h is the height of the base 2 of the fin strip 4 from which the fins 3 extend, i.e., a portion of the fin strip 4 not provided with any slits (FIG. 4), and H is the overall height of the fin strip 4 including the fins 3, not smaller than 1.5, preferably, in the range of 3 to 15. In the prior art fin strip having an L-shaped cross section and fins formed by slitfing the peripheral portion thereof, the fin strip is attached to a tube at a setfing angle, i.e., a fin inclination angle θ, of zero degree, nothing is considered about the fin slit ratio (H/h) mentioned in the invention previously proposed by the inventors of the present invention, and any particulars about the twist angle of the fins of the fin strip are not taken into consideration. The inventors of the present invention had not taken particulars about the twist angle of the fins of the fin strip into consideration in making the invention previously proposed by the inventors.

Accordingly, it is an object of the present invention to provide a finned tube of a construction having an improved heat transfer coefficient. Another object of the present invention is to provide a heat exchanger having an improved heat transfer coefficient. A further object of the present invention is to provide a heat recovery system provided with a heat exchanger having an improved heat transfer coefficient.

DISCLOSURE OF THE INVENTION

The present invention provides a finned tube comprising: a tube; and a fin strip having fins formed by forming slits of a predetermined length in a fin portion of a strip perpendicularly to the length of the strip and at predetermined intervals, and a base portion in which no slit is formed, and wound around the tube so that the fins thereof extend substantially radially of the tube; characterized in that the fins are twisted at a twist angle in the range of 2° to 40° to a contact line along which the base portion of the fin strip is in contact with the tube, and inclined at an inclination angle in the range of 2° to 20° to a straight line perpendicular to the axis of the tube.

The present invention provides a heat exchanger provided with a plurality of the aforesaid finned tubes.

The present invention further provides a heat recovery system comprising a heat exchanger having a plurality of the aforesaid finned tubes, and disposed within a combustion gas passage with the finned tubes extending with their axes perpendicular to the longitudinal direction of the combustion gas passage and with the fins of the finned tubes declined to a straight line perpendicular to the axes of the tubes, or a heat recovery system comprising the heat exchanger having a plurality of the aforesaid finned tubes and disposed within a combustion gas passage with fins of the adjacent finned tubes inclined to a straight line perpendicular to the axes of the tubes in opposite directions, respectively, and with the finned tubes extended with their axes in a horizontal position.

FIG. 7 shows the relation between the twist angle α of the fins of the fin strip and heat transfer coefficient ratio when the inclination angle θ, i.e., the angle between the fins of the fin strip to a straight line perpendicular to the axis of the tube, is 10°. As is obvious from FIG. 7, the heat transfer coefficient ratio increases with the increase of the twist angle α from 2° to 40°. The inclination angle θ of the fins must be 20° or below because the adjacent winds of the fin strip interfere with each other when the fin strip is wound around the tube if the inclination angle θ is excessively large, and an inclination angle θ less than 2° is ineffective in enhancing the heat transfer performance of the finned tube. Therefore a desirable inclination angle θ is in the range of 2° to 20°.

Inclining the fins at the inclination angle θ contributes to the enhancement of thermal transfer efficiency, and twisfing the fins at the twist angle α and inclining the fins at the inclination angle θ are effective in enhancing the heat transfer efficiency.

Thus, the employment of the finned tubes of the present invention having fins twisted at a given twist angle α and inclined at a given inclination angle θ enhances heat transfer coefficient, and the finned tube of the present invention has a lightweight construction.

From the viewpoint of heat transfer performance, it is preferable that the fin slit ratio H/h of the fin strips of the finned tubes is 1.5 or above, more preferably, in the range of 3 to 15.

Highest heat transfer performance can be secured when the ratio H/S, where H is the overall height of the fin strip and S is the pitch of the winds of the fin strip 4 wound around the tube 1 (see FIG. 9), is in the range of about 3.0 to about 8.0. When the ratio H/S is in such a range, the weight of the finned tube can be greatly reduced.

In the finned tube of the present invention, the fin strip may be entirely inclined to a straight line perpendicular to the axis of the tube or only the fins of the fin strip may be inclined to a straight line perpendicular to the axis of the tube.

The heat exchanger provided with the finned tubes of the present invention is applicable to air conditioners, cleaning filters, cross-flow blowers, refrigerators and such as well as to the heat recovery apparatus for recovering heat from a combustion gas.

BEST MODE FOR CARRYING OUT THE INVENTION

Figure 1:
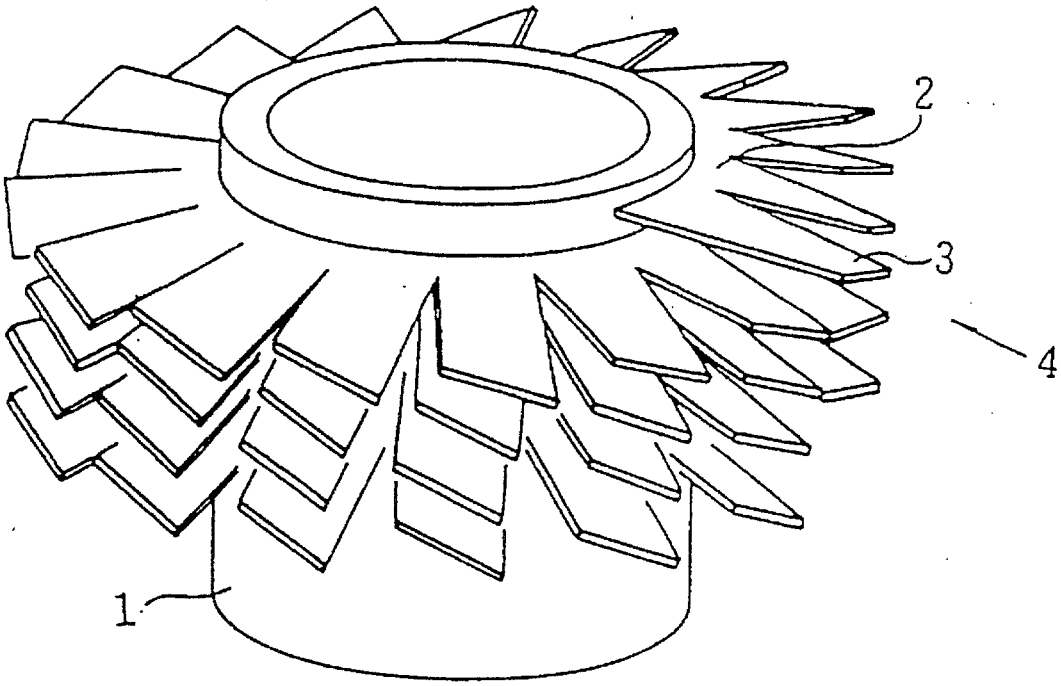
FIG. 1 is a perspective view of a finned tube in a first embodiment according to the present invention.

Preferred embodiments of the present invention will be described hereinafter with reference to the accompanying drawings, in which parts like or corresponding to those of the previously described prior art finned tube are designated by the same reference characters. It is to be noted that the present invention is not limited in its practical application to the preferred embodiments to be described specifically hereinafter.

Figure 2:
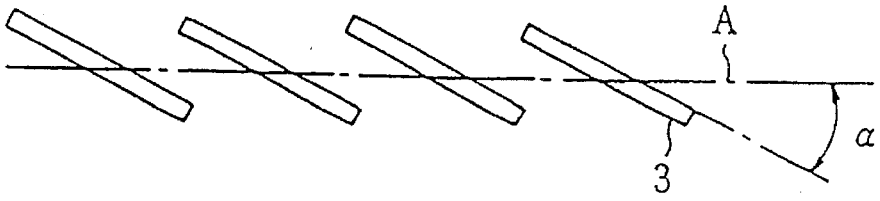
FIGS. 2 is a diagrammatic view of assistance in explaining the twist angle of the fins of the fin strip of the finned tube of FIG. 1.
Figure 3:
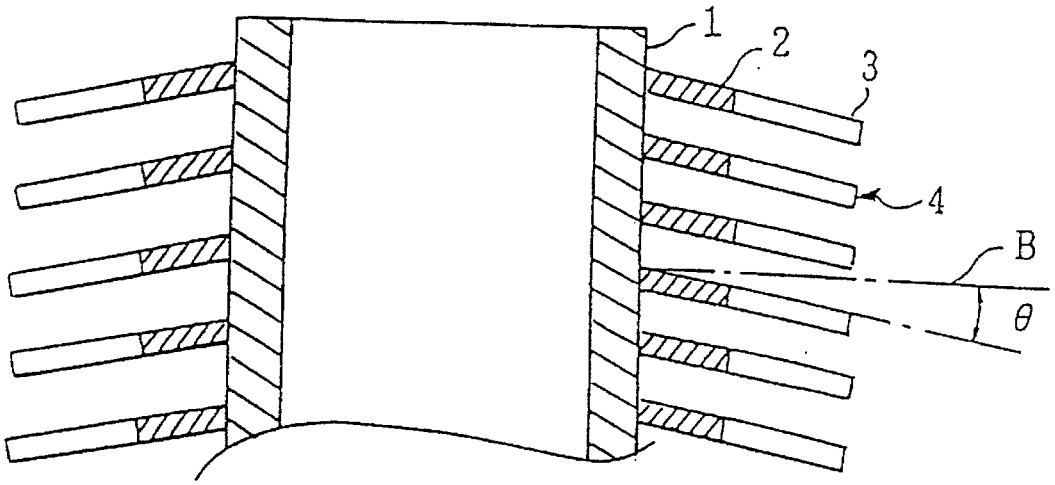
FIG. 3 is a longitudinal sectional view of the finned tube of FIG. 1.
Figure 4:
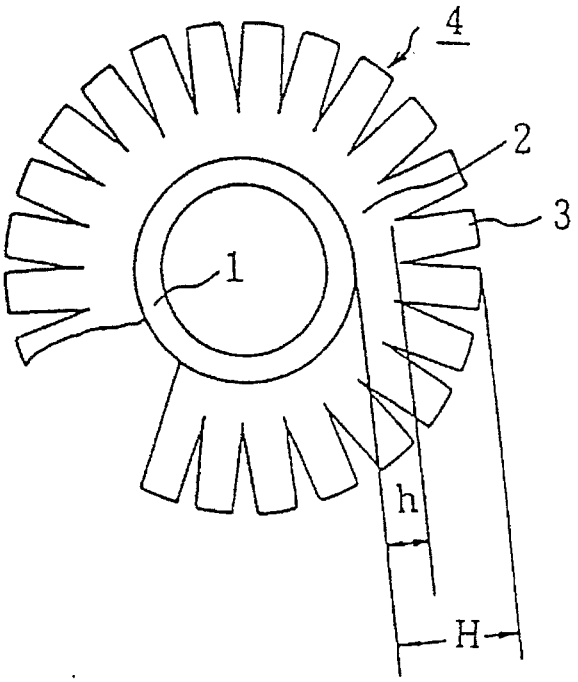
FIG. 4 is a plan view of the finned tube of FIG. 1 as viewed axially from one end of the finned tube.

Referring to FIG. 1 showing a heat exchanger provided with finned tubes embodying the present invention in a perspective view, the finned tube is formed by helically winding a fin strip 4 having a base portion 2 and fins 3 around a tube 1. FIG. 2 is a view of assistance in explaining the twist angle α of the fins 3 of the fin strip 4 of FIG. 1, i.e., the angle of the fins 3 to a contact line A along which the base portion 2 is in contact with the tube 1. FIG. 3 is a longitudinal sectional view of the finned tube of FIG. 1, in which a plane including the base portion 2 and each fin of the fin strip 4 helically wound around the tube 1 is inclined at an inclination angle θ to a straight line B perpendicular to the axis of the tube 1.

Figure 5:
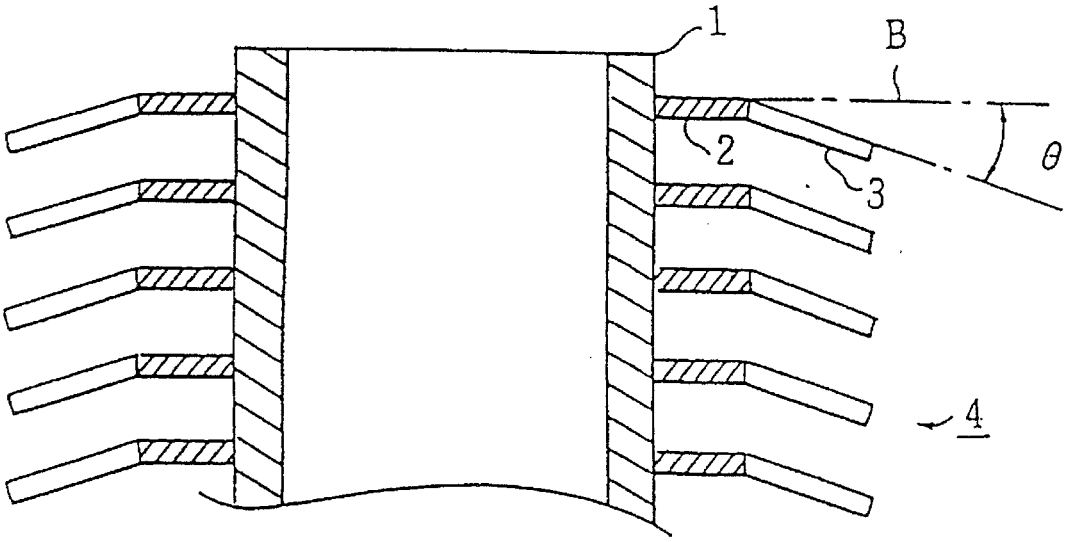
FIG. 5 is a longitudinal sectional view of a finned tube in a second embodiment according to the present invention.

FIG. 5 is a longitudinal sectional view of a finned tube in another embodiment according to the present invention having a tube 1. In this embodiment, a fin strip 4 is wound helically around the tube 1 with the base portion 2 thereof extended along a straight line B perpendicular to the axis of the tube 1, and only the fins 3 of the fin strip 4 are inclined at an inclination angle θ, i.e., an angle between a plane including the fin 3 of the fin strip 4 wound helically around the outer circumference of the tube 1 and a straight line B perpendicular to the axis of the tube 1.

Figure 6:
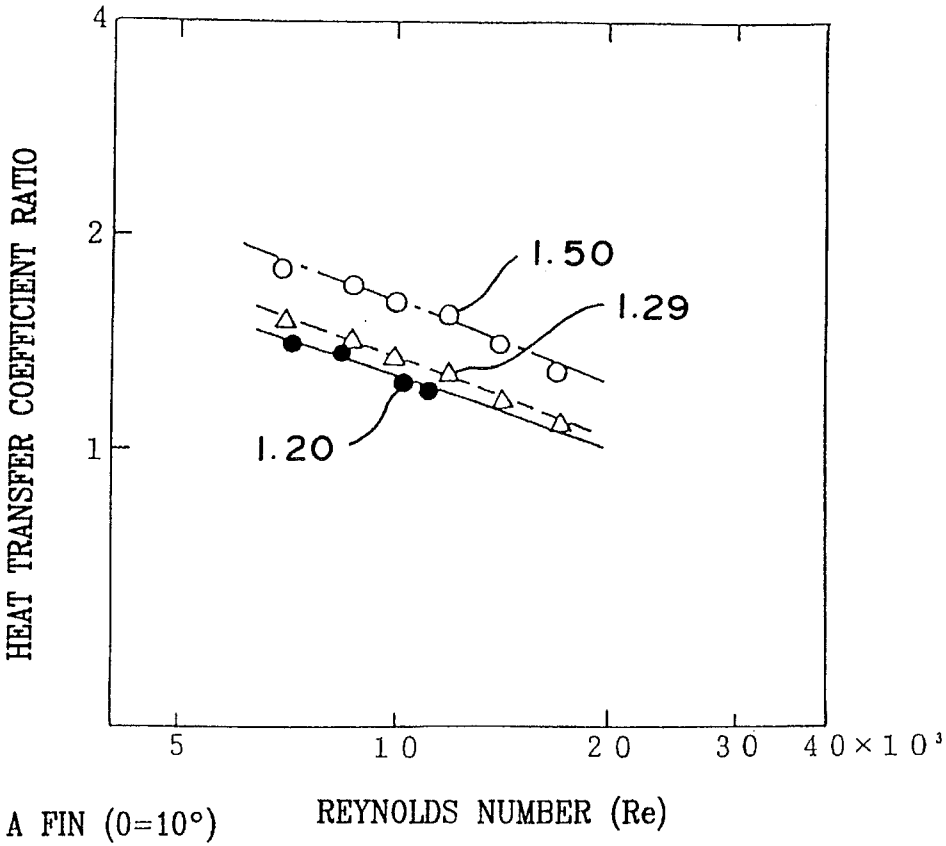
FIG. 6 is a graph showing the dependence of heat transfer coefficient ratio on the inclination angle θ and the twist angle α of the fins of finned tubes embodying the present invention.
Figure 7:
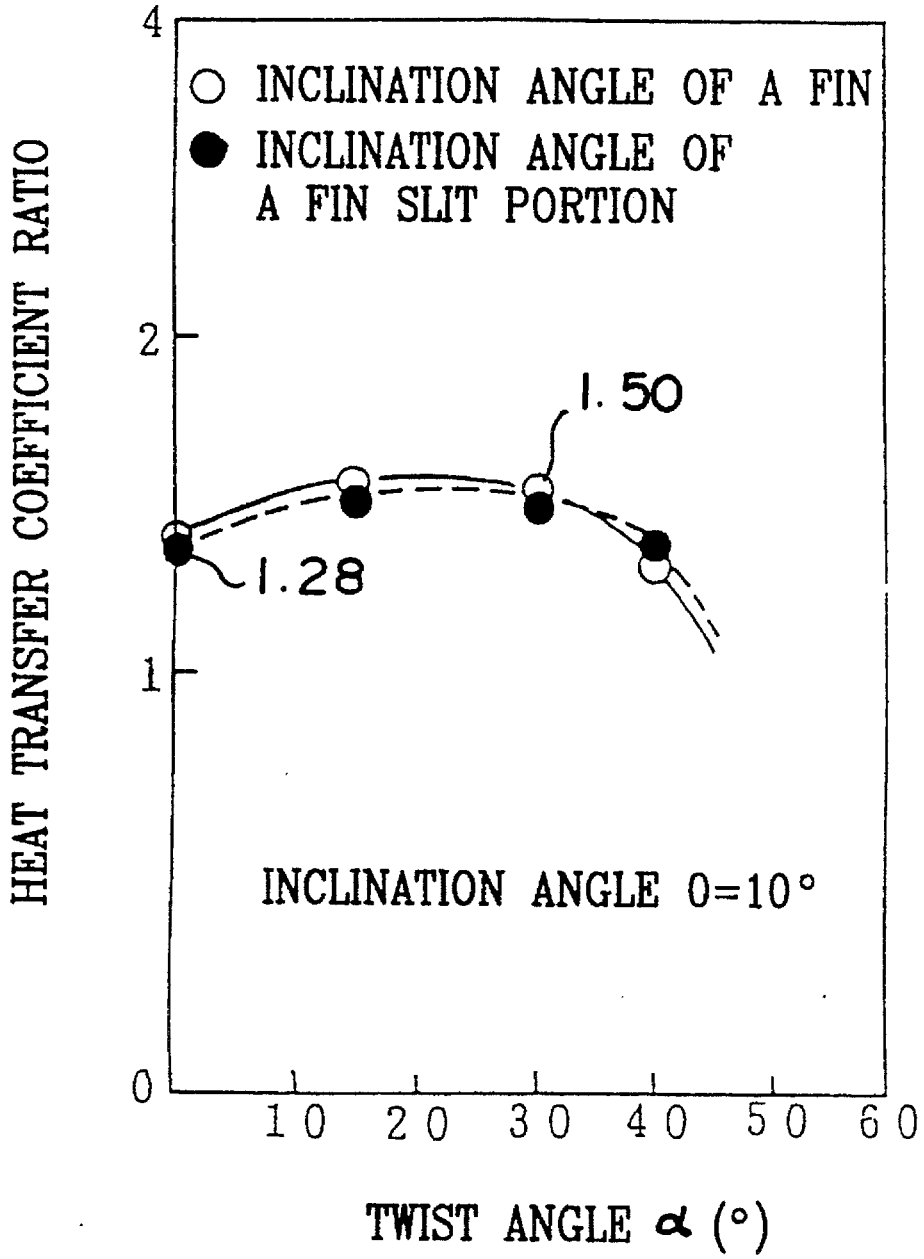
FIG. 7 is a graph showing variation of heat transfer coefficient ratio with the twist angle α of finned tubes embodying the present invention.

Measured data of heat transfer efficiency of the finned tube, in which the fins 3 of the finned strip 4 are inclined at an inclination angle θ and twisted at a twist angle α is shown in FIGS. 6 and 7. In FIG. 6, solid circles indicate the variation of heat transfer coefficient ratio with Reynolds number (Re) when both the twist angle α and the inclination angle θ are zero, blank triangles indicate the variation of heat transfer coefficient ratio with Reynolds number (Re) when the inclination angle θ of the fins 3 is zero, the twist angle α of the fins 3 is 30° and the inclination angle θ of the base portion, i.e., the angle between a plane including the base portion 2 of the fin strip 4 helically wound around the tube 1 and a straight line perpendicular to the axis of the tube 1, is in the range of 0° to 10°, and blank circles indicate the variation of heat transfer coefficient ratio with Reynolds number (Re) when the twist angle α of the fins is 30° and the inclination angle θ of a plane including the base portion 2 and each fin 3 of the fin strip 4 is 10°.

Heat transfer coefficient ratio is a comparative value of the Colburn's J-factor to a specific reference value. In this embodiment, the specific reference value is the value of J-factor corresponding to a solid circle for $Re=20\times10^3$ (both the twist angle α and the inclination angle θ of the fin strip 4 are zero) in FIG. 6.

Reynolds number Re is expressed by:

$Re=DG/\mu$ where D is the outside diameter of the tube, G is the mass flow rate of the exhaust gas and μ is the dynamic viscosity coefficient of the exhaust gas.

In the finned tube tested to obtain the data shown in FIG. 6, the outside diameter of the tube is 31.8 mm, the pitch of the winds of the fin strip is 3.63 mm, the overall height of the fin strip is 12.7 mm, the thickness of the fin strip is 1.2 mm, the fin density is 7.0 fins/in. and the fin slit ratio (H/h) is 2.5.

As is obvious from FIG. 6, the heat transfer coefficient ratio when the twist angle α of the fins 3 is 30° and the inclination angle θ is zero is higher than that when both the twist angle α and the inclination angle θ of the fins 3 are zero. The heat transfer coefficient ratio is still further when the twist angle α of the fins 3 is 30° and the inclination angle θ of the same is 10°. It is to be noted that, as indicated by blank triangles, the heat transfer coefficient ratio remains unchanged even if only the inclination angle of only the base portion 2 is varied in the range of 0° to 10°, which proves that the inclination angle of the base portion 2 does not contribute to the enhancement of heat transfer efficiency. The data indicated by blank triangles is for a condition where the inclination angle θ of the fins 3 is zero, while the data indicated by blank circles is for a condition where the fins 3 are inclined at an inclination angle θ. As is obvious from the comparative examination of the data indicated by blank triangles and that indicated by blank circles, the inclination of the fins 3 at an inclination angle θ contributes to the enhancement of heat transfer efficiency. Accordingly, it is known from the measured results shown in FIG. 6 that inclining the fins 3 of the fin strip 4 at an inclination angle θ in addition to twisfing the fins 3 at a twist angle α is effective in enhancing the heat transfer efficiency.

FIG. 7 shows the dependence of heat transfer coefficient ratio on twist angle α of the fins 3. In the finned tube tested to obtain the data shown in FIG. 7, the outside diameter of the tube is 31.8 mm, the pitch of winds of the fin strip is 3.63 mm, the overall height of the fin strip is 12.7 mm, the thickness of the fin plate is 1.0 mm, the inclination angle θ of the fins is 10° and the fin slit ratio (H/h) is 2.5.

As is obvious from FIG. 7, heat transfer coefficient ratio when the fin strip 4 is inclined at an inclination angle θ (FIG. 3) (data indicated by blank circles) is substantially equal to that when only the fins 3 are inclined at an inclination angle θ (FIG. 5) (data indicated by solid circles), the heat transfer coefficient is large when the twist angle α is in the range of 2° to 40°, and the inclination of the base portion 2 to a straight line perpendicular to the axis of the tube 1 does not contribute to the enhancement of heat transfer efficiency.

It is concluded from FIGS. 6 and 7 that the inclination of the base portion 2 of the fin strip 4 to a straight line perpendicular to the axis of the tube 1 is ineffective in enhancing heat transfer efficiency, the inclination of the fins 3 at an inclination angle θ and twisfing the fins 3 at a twist angle α in the range of 2° to 40° enhance the heat transfer performance of the finned tube.

The fin strip 4 is wound around the tube 1 with the base portion 2 thereof in contact with the outer circumference of the tube 1 and is welded to the tube 1 by micro wave welding. The inclination angle θ of the fins 3 must be 20° or below to prevent interference between the fins 3 of the adjacent winds of the fin strip 4 when helically winding the fin strip 4 around the tube 1 and welding the same to the tube 1 and, since an inclination angle θ less than 2° is ineffective in enhancing the heat transfer performance, a desirable inclination angle θ is in the range of 2° to 20°.

Figure 8:
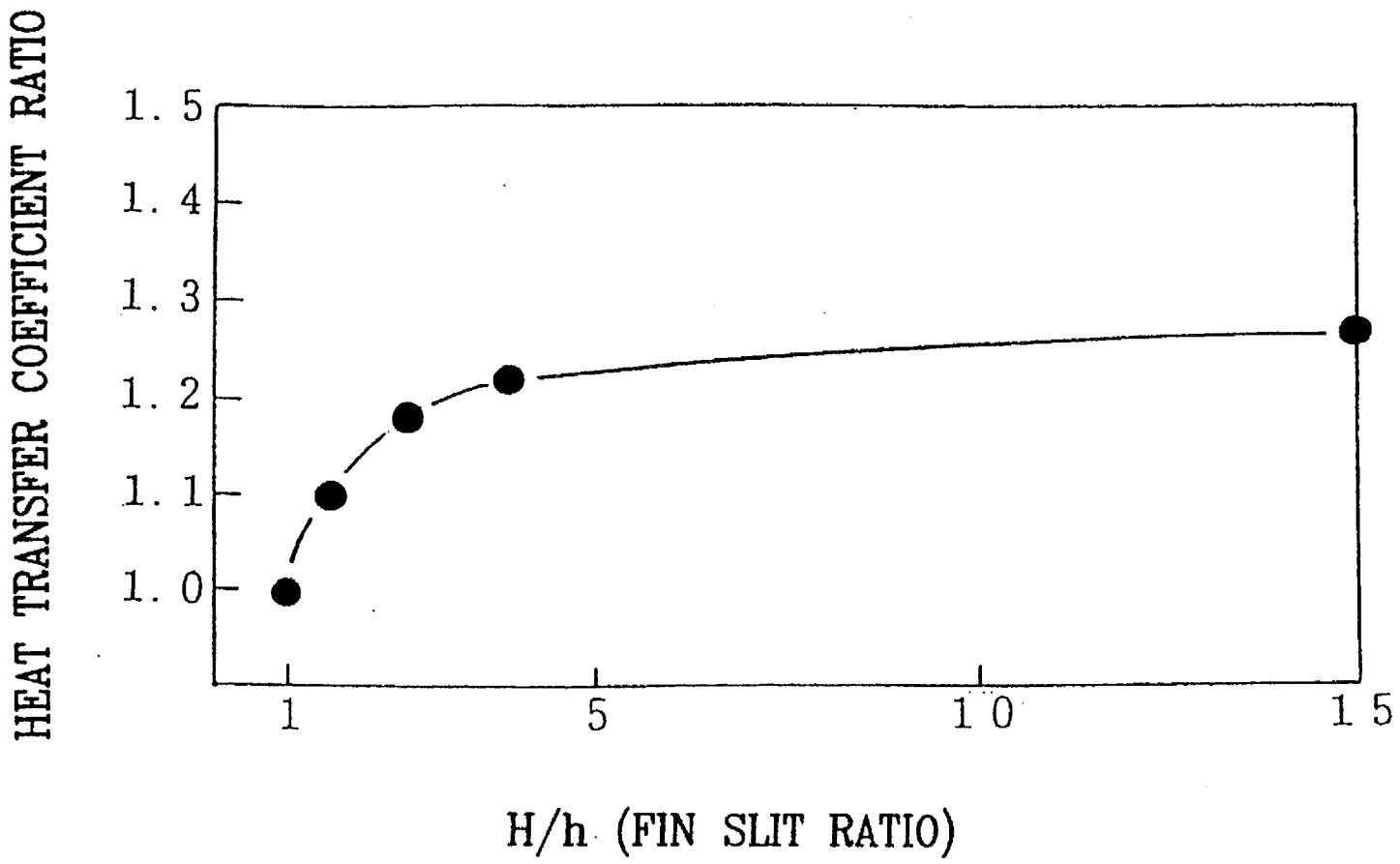
FIG. 8 is a graph showing the relation between the fin slit ratio of the fin strip and the heat transfer coefficient ratio of finned tubes embodying the present invention.

FIG. 8 shows the dependence of heat transfer coefficient ratio on the fin slit ratio. In a finned tube tested to obtain the data shown in FIG. 8, the outside diameter of the tube is 50.8 mm, the pitch of the winds of the fin strip is 3.63 mm, the overall height of the fin strip is 19.05 mm, the thickness of the fin strip is 1.2 mm, the twist angle α is 30° and the inclination angle θ of the fins is 10°.

It is known from FIG. 8 that, from the viewpoint of heat transfer performance, preferably the fin slit ratio (H/h) is 1.5 or greater, more preferably in the range of 3 to 15. When the fin slit ratio H/h is 1.5 or above, preferably, in the range of 3 to 15, the width of creases that are formed in the base portion of the fin strip 4 when winding the fin strip 4 around the tube 1 is small and draft loss caused by a heat exchanger provided with the finned tubes and disposed in an exhaust gas duct is reduced, which is described also in Japanese Patent Laid-open Publication No. 4-126997 of the inventors of the present invention.

Figure 9:
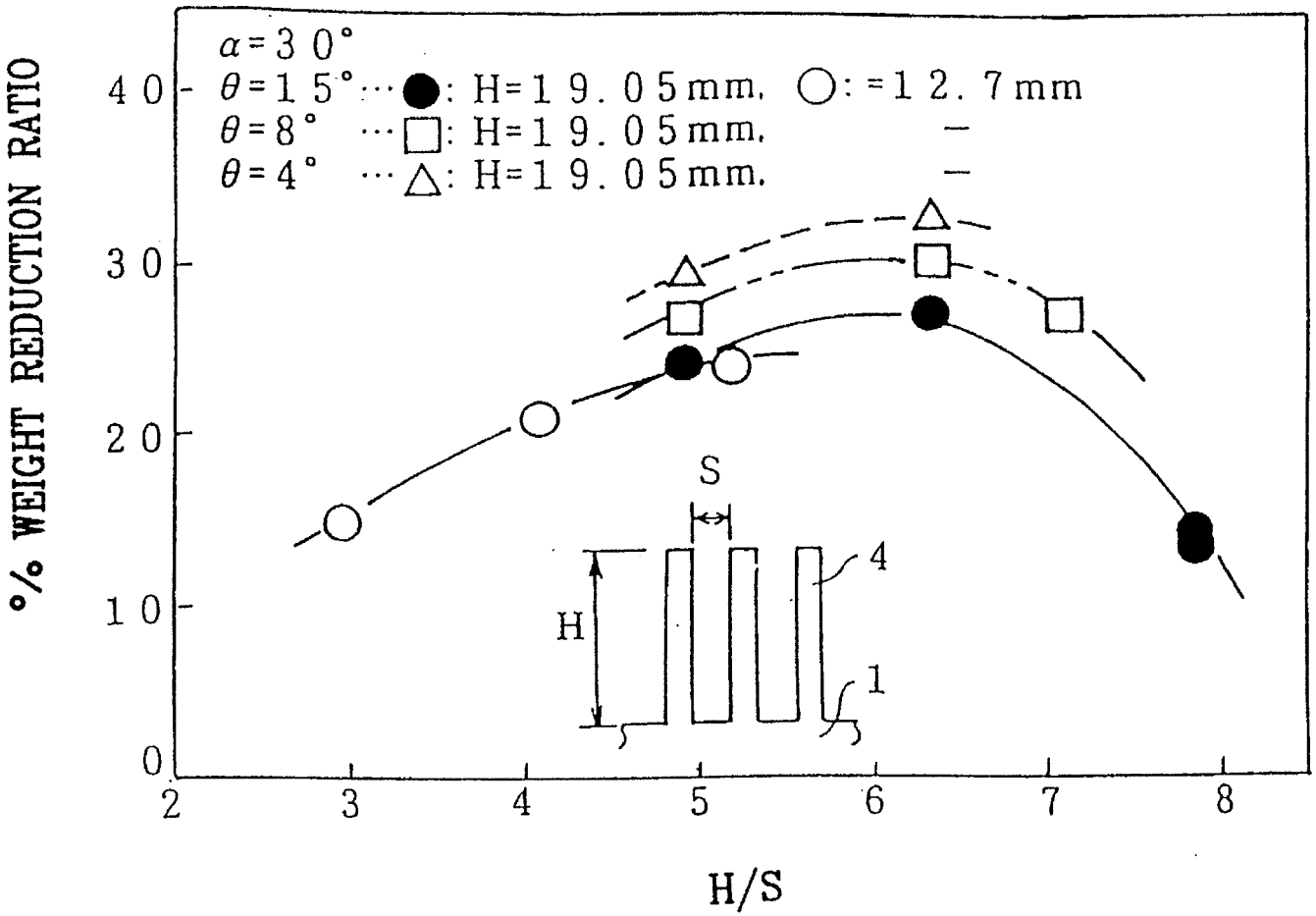
FIG. 9 is a graph showing the relation between the ratio of the overall height H of the fin strip of a finned tube embodying the present invention to the pitch S of winds of the fin strip, and the weight reduction ratio of the finned tube for the inclination θ of the fins of the finned tube as a parameter.

FIG. 9 shows the dependence of the effect of the H/S ratio, i.e., the ratio of the overall height H of the fin strip 4 to the pitch S of the winds of the fin strip 4 helically wound around the tube 1, on the reduction of the weight of the finned tube 1 of a construction shown in FIG. 3. In the finned tubes tested to obtain the data shown in FIG. 9, the twist angle α of the fins 2 is 30°, the overall heights H of the fin strips 4 are 19.05 mm and 12.7 mm, and the inclination angles θ are 4°, 8° and 15°, respectively. Since increase in the heat transfer efficiency entails the reduction of the weight of the heat exchanger, the weight reduction ratio of the heat transfer tube is an index of heat transfer performance.

It is known from FIG. 9 that the heat transfer performance of the heat transfer tube is high when the ratio H/S is in the range of about 3.0 to about 8.0, which is effective in enhancing the weight reduction ratio of the heat transfer tube.

Figure 10A:
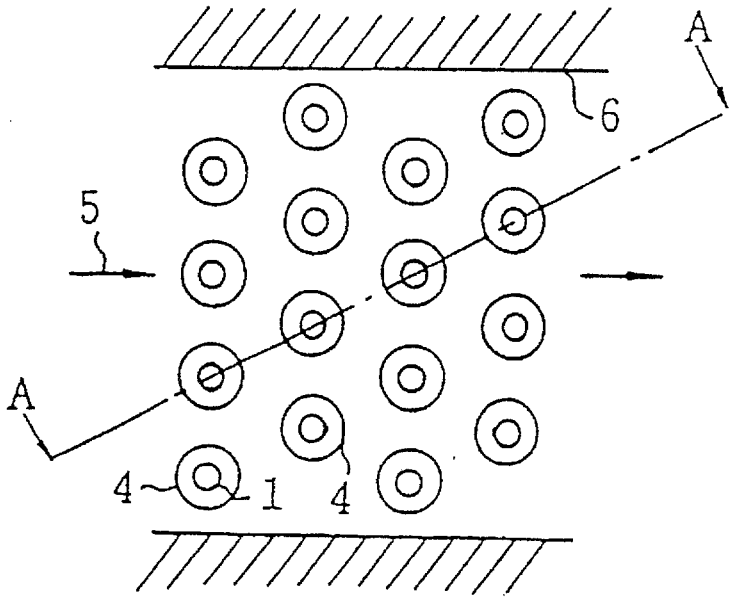
FIG. 10(*a*) is a plan view of a heat exchanger provided with finned tubes embodying the present invention and disposed within a combustion gas duct with the longitudinal axes of the finned tubes vertically extended and the fin strips inclined downward, and FIG. 10(*b*) is a sectional view taken on line A—A in FIG. 10(*a*)
Figure 10B:
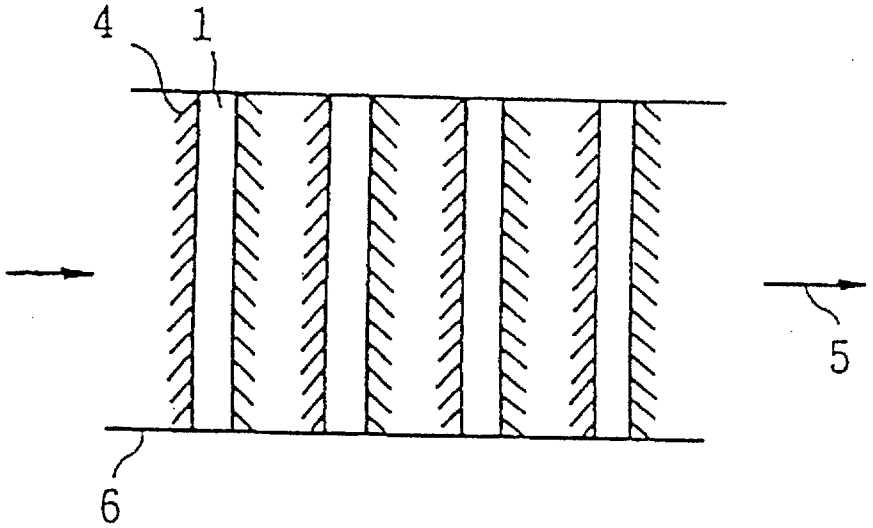
Figure 11:
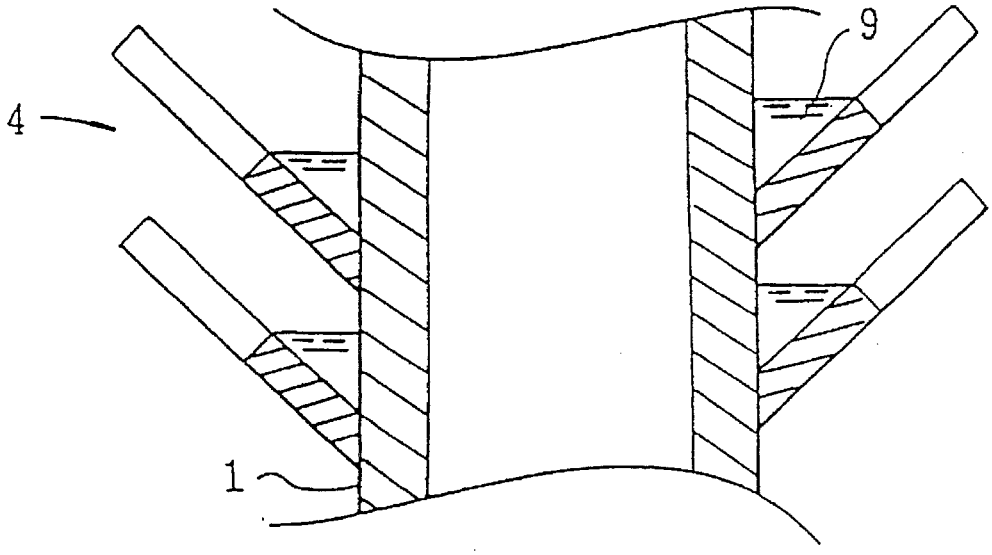
FIG. 11 (PRIOR ART)
FIG. 11 is a fragmentary longitudinal sectional view of assistance in explaining problems that arise when a heat exchanger provided with finned tubes is disposed within a combustion gas duct with the fins of the finned tubes inclined upward.
Figure 12:
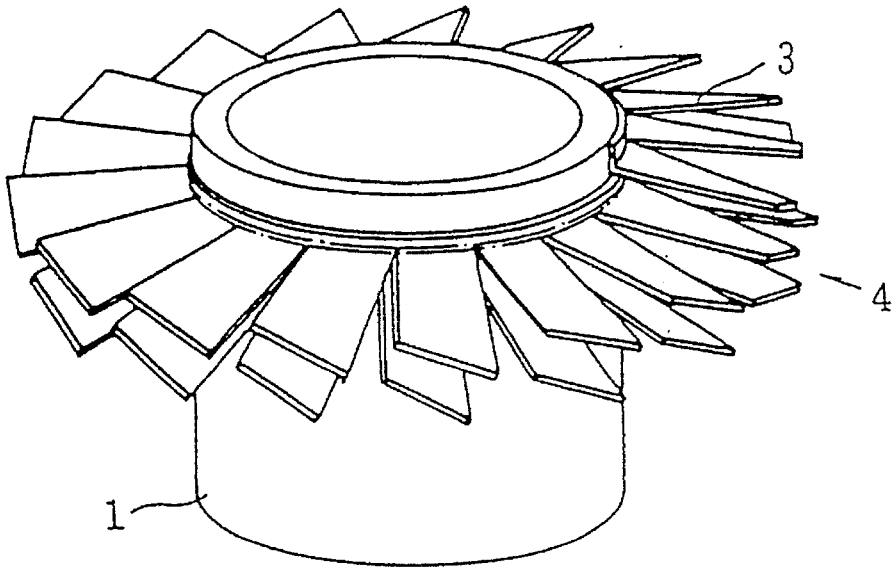
FIG. 12 is a perspective view of a prior art finned tube.

FIG. 10(*a*) is a plan view showing the arrangement of the finned tubes 1 of a heat exchanger when the heat exchanger is disposed within a duct 6 forming a flow passage for a gas flow 5 with the longitudinal axes of the finned tubes 1 extended vertically, and FIG. 10(*b*) is a sectional view taken along line A—A in FIG. 10(*a*). In the embodiment shown in FIGS. 10(*a*) and 10(*b*), the fin strips 4 are inclined downward with respect to the axes of the tubes 1. If the fin strips 4 are inclined upward with respect to the axes of the tubes 1 as shown in FIG. 11, washing water will stay at the junctions of the fin strips 4 and the tubes 1 when the finned tubes are washed and the washing water staying at the junctions will cause the corrosion of the heat exchanger.

When a heat exchanger, not shown, is disposed in the combustion gas duct 6 with the longitudinal axes of the finned tubes extended horizontally, the washing water drains off readily from the finned tubes regardless of the direction of inclination of the fin strips 4. Therefore, it is desirable to arrange finned tubes 1 having fin strips 4 inclined in one direction and finned tubes 1 having fin strips 4 inclined on the opposite direction alternately, because such an arrangement of the finned tubes 1 disturbs the gas flow 5 and enhances the heat exchanging efficiency.

Since the finned tubes of the present invention has a complicated construction having minute spaces formed between the winds of the fin plate 4 having a complicated shape for heat exchanging, it is desirable to use the finned tubes in a combustion gas duct connected to a combustion apparatus that burns a clean fuel, such as LNG, and the combustion gas discharged from the combustion apparatus contains dust and sulfur oxides scarcely.

However, even if the combustion gas has a high dust concentration or a high sulfur oxide concentration, the heat exchanger provided with the finned tubes of the present can be used in combination with a washing apparatus in a duct through which a combustion gas having a high dust concentration or a high sulfur oxide concentration flows. Such a combustion gas is denitrated using ammonia. In some cases, when the combustion gas is denitrated, acid ammonium sulfate produced by the reaction between sulfur oxides and leak ammonia deposits on the finned tubes. Dust is liable to adhere to the finned tubes. In some cases, sulfur oxides condense on the finned tubes on the side where temperature is comparatively low and produce sulfuric acid. However, as mentioned above, the deposits adhering to the finned tubes can be effectively removed by periodically washing the finned tubes. Accordingly, the heat exchanger provided with the finned tubes of the present invention can be used as a heat recovery apparatus to be disposed in a combustion gas duct for a boiler having a furnace, such as a boiler for power generation or in a exhaust gas duct for a heat recovery boiler.

A boiler uses a finned tube bent in a plurality of rows of sections as a superheater tube, and a part of the superheater tube is extended outside the exhaust gas duct as a cooling part, and water is sprayed on the cooling part by a temperature reducing apparatus to control the temperature of the superheated steam. Since steam condenses if the temperature of the superheated steam is decreased to a temperature below the saturation temperature, cooling water must be sprayed on the cooling part of the superheafing tube so that the temperature of the superheated steam is well above the saturation temperature and is in the range of superheafing temperatures to avoid the condensation of superheated steam. Therefore, it has been necessary to extend a part of the superheafing tube on the side of comparatively high temperature as a cooling part to the temperature reducing apparatus. When the finned tube with a high heat transfer performance of the present invention is used as the superheafing tube, the temperature of steam even in a part of the superheafing tube on the side of comparatively low temperature is well above the saturation temperature. Therefore, such a part of the superheafing tube may be extended outside the combustion gas duct to use the same as a cooling part and, consequently, the difference between the temperature of cooling water and that of the cooling part of the superheafing tube is relatively small, which reduces thermal stress induced in the superheafing tube and prevents damaging the cooling part of the superheafing tube.

CAPABILITY OF EXPLOITATION IN INDUSTRY

The heat exchanger employing the finned tube of the present invention is applicable to air conditioners, cleaning filters, cross-flow blowers, refrigerators and such as well as to heat recovery apparatus for recovering heat from combustion gases.

We claim:

1. A finned tube comprising: a tube; and a fin strip having fins formed by forming slits of a predetermined length in a fin portion of a strip perpendicularly to the length of the strip and at predetermined intervals, and a base portion in which no slit is formed, and wound around the tube so that the fins thereof extend substantially radially of the tube; characterized in that the fins are twisted at a twist angle in the range of 2° to 40° to a contact line along which the base portion of the fin strip is in contact with the tube, and inclined at an inclination angle in the range of 2° to 20° to a straight line perpendicular to the axis of the tube.

2. A finned tube according to claim 1, wherein the ratio H/h is 1.5 or above, where H is the overall height of the fin strip and h is the height of the base portion.

3. A finned tube according to claim 1, wherein the ratio H/S is in the range of 3.0 to 8.0, where S is the pitch of winds of the fin strip wound around the tube and H is the overall height of the fin strip.

4. A finned tube according to claim 1, wherein the fin strip is inclined to a straight line perpendicular to the axis of the tube and extending across the contact line.

5. A finned tube according to claim 1, wherein only the fins of the fin strip are inclined to a straight line perpendicular to the axis of the tube.

6. A heat exchanger comprising a plurality of finned tubes each comprising: a tube; and a fin strip having fins formed by forming slits of a predetermined length in a fin portion of a strip perpendicularly to the length of the strip and at predetermined intervals, and a base portion in which no slit is formed, and wound around the tube so that the fins thereof extend substantially radially of the tube; characterized in that the fins are twisted at a twist angle in the range of 2° to 40° to a contact line along which the base portion of the fin strip is in contact with the tube, and inclined at an inclination angle in the range of 2° to 20° to a straight line perpendicular to the axis of the tube.

7. A heat exchanger according to claim 6, wherein the ratio H/h is 1.5 or above, where H is the overall height of the fin strip and h is the height of the base portion.

8. A heat exchanger according to claim 6, wherein the ratio H/S is in the range of 3.0 to 8.0, where S is the pitch of winds of the fin strip wound around the tube and H is the overall height of the fin strip.

9. A heat exchanger according to claim 6, wherein the fin strip is inclined to a straight line perpendicular to the axis of the tube and extending across the contact line.

10. A heat exchanger according to claim 6, wherein only the fins of the fin strip are inclined to a straight line perpendicular to the axis of the tube.

11. A heat recovery apparatus comprising a heat exchanger comprising a plurality of finned tubes each comprising: a tube; and a fin strip having fins formed by forming slits of a predetermined length in a fin portion of a strip perpendicularly to the length of the strip and at predetermined intervals, and a base portion in which no slit is formed, and wound around the tube so that the fins thereof extend substantially radially of the tube; characterized in that the fins are twisted at a twist angle in the range of 2° to 40° to a contact line along which the base portion of the fin strip is in contact with the tube, and inclined at an inclination angle in the range of 2° to 20° to a straight line perpendicular to the axis of the tube; and disposed within a combustion gas passage with the longitudinal axes of the finned tubes thereof vertically extended so that the fins thereof are inclined downward from a straight line perpendicular to the axes of the tubes.

12. A heat recovery apparatus according to claim 11, wherein the ratio H/h is 1.5 or above, where H is the overall height of the fin strip and h is the height of the base portion of the fin strip.

13. A heat recovery apparatus according to claim 11, wherein the ratio H/S is in the range of 3.0 to 8.0, where S is the pitch of winds of the fin strip wound around the tube, and H is the overall height of the fin strip.

14. A heat recovery apparatus according to claim 11, wherein the fin strip is inclined to a straight line perpendicular to the axis of the tube and extending across the contact line.

15. A heat recovery apparatus according to claim 11, wherein only the fins of the fin strip are inclined to a straight line perpendicular to the axis of the tube.

16. A heat recovery apparatus comprising a heat exchanger comprising a plurality of finned tubes each comprising: a tube; a fin strip having fins formed by forming slits of a predetermined length in a fin portion of a strip perpendicularly to the length of the strip and at predetermined intervals, and a base portion in which no slit is formed, and wound around the tube so that the fins thereof extend substantially radially of the tube; characterized in that the fins are twisted at a twist angle in the range of 2° to 40° to a contact line along which the base portion of the fin strip is in contact with the tube, and inclined at an inclination angle in the range of 2° to 20° to a straight line perpendicular to the axis of the tube, and the respective directions of inclination of the fins of the adjacent finned tubes are opposite to each other; and disposed in a combustion gas passage with the longitudinal axes of the finned tubes horizontally extended.

17. A heat recovery apparatus according to claim 16, wherein the ratio H/h is 1.5 or above, where H is the overall height of the fin strip and h is the height of the base portion of the fin strip.

18. A heat recovery apparatus according to claim 16, wherein the ratio H/S is in the range of 3.0 to 8.0, where S is the pitch of winds of the fin strip wound around the tube and H is the overall height of the fin strip.

19. A heat recovery apparatus according to claim 16, wherein the fin strip is inclined to a straight line perpendicular to the axis of the tube and extending across the contact line.

20. A heat recovery apparatus according to claim 16, wherein only the fins of the fin strip are inclined to a straight line perpendicular to the axis of the tube.

21. A finned tube according to claim 1 wherein said fin strip defines a longitudinal edge at its base portion and wherein said edge is welded to said tube in a T-joint.

22. A finned tube according to claim 6 wherein said fin strip defines a longitudinal edge at its base portion and wherein said edge is welded to said tube in a T-joint.

23. A finned tube according to claim 11 wherein said fin strip defines a longitudinal edge at its base portion and wherein said edge is welded to said tube in a T-joint.

24. A finned tube according to claim 16 wherein said fin strip defines a longitudinal edge at its base portion and wherein said edge is welded to said tube in a T-joint.

25. A finned tube according to claim 21 wherein said weld has been formed by microwave welding.

26. A finned tube according to claim 22 wherein said weld has been formed by microwave welding.

27. A finned tube according to claim 23 wherein said weld has been formed by microwave welding.

28. A finned tube according to claim 24 wherein said weld has been formed by microwave welding.

* * * * *

UNITED STATES PATENT AND TRADEMARK OFFICE

CERTIFICATE OF CORRECTION

PATENT NO. : 5,617,916

DATED : April 8, 1997

INVENTOR(S) : SHIGENAKA et al

It is certified that error appears in the above-identified patent and that said Letters Patent is hereby corrected as shown below:

Col. 1, line 16, "slitfing" should read --slitting--;

line 19, "slitfing" should read --slitting--; and line 35, "slitfing" should read --slitting--.

Col. 2, line 31, "twisfing" should read --twisting--.

Col. 5, line 18, "twisfing" should read --twisting--.

Col. 6, line 58, "superheafing" should read --superheating--;

line 60, "superheafing" should read --superheating--;

line 63, "superheafing" should read --superheating--;

line 67, "heafing" should read --heating--.

Col. 7, line 1, "superheafing" should read --superheating--;

line 3, "superheafing" should read --superheating--;

line 6, "superheafing" should read --superheating--;

line 8, "superheafing" should read --superheating--;

and

UNITED STATES PATENT AND TRADEMARK OFFICE

CERTIFICATE OF CORRECTION

PATENT NO. : 5,617,916
DATED : April 8, 1997
INVENTOR(S) : SHIGENAKA et al.

It is certified that error appears in the above-identified patent and that said Letters Patent is hereby corrected as shown below:

line 9, "superheafing" should read --superheating--.

Signed and Sealed this

Seventeenth Day of March, 1998

*Attest:*

*Attesting Officer*

BRUCE LEHMAN

*Commissioner of Patents and Trademarks*